US007222003B2

(12) United States Patent
Stull et al.

(10) Patent No.: US 7,222,003 B2
(45) Date of Patent: May 22, 2007

(54) METHOD AND COMPUTER PROGRAM PRODUCT FOR MONITORING INTEGRITY OF RAILROAD TRAIN

(75) Inventors: Craig Stull, Kansas City, MO (US); Jason Orme, Warrensburg, MO (US); Jeff Baker, Olathe, KS (US); Curt Crandall, Buckner, MO (US)

(73) Assignee: General Electric Company, Schenectady, NY (US)

( * ) Notice: Subject to any disclaimer, the term of this patent is extended or adjusted under 35 U.S.C. 154(b) by 217 days.

(21) Appl. No.: 11/167,015

(22) Filed: Jun. 24, 2005

(65) Prior Publication Data

US 2006/0290478 A1 Dec. 28, 2006

(51) Int. Cl.
*G05D 1/00* (2006.01)

(52) U.S. Cl. ..... 701/19; 701/213; 701/300

(58) Field of Classification Search ..... 701/1, 701/19, 36, 200–216, 300, 301; 246/167 R, 246/176, 17; 340/902, 903, 904
See application file for complete search history.

(56) References Cited

U.S. PATENT DOCUMENTS 3,967,801 A 7/1976 Baughman
5,129,605 A 7/1992 Burns et al.
5,364,047 A 11/1994 Petit et al.
5,398,894 A 3/1995 Pascoe
5,452,870 A 9/1995 Heggestad
5,533,695 A 7/1996 Heggestad et al.
5,738,311 A 4/1998 Fernandez
5,757,291 A 5/1998 Kull
5,813,635 A 9/1998 Fernandez
5,817,934 A 10/1998 Skantar
5,823,481 A 10/1998 Gottschlich
5,950,967 A 9/1999 Montgomery
6,032,905 A 3/2000 Haynie
6,311,109 B1 10/2001 Hawthorne et al.
6,375,275 B1 4/2002 Smith, Jr. et al.
6,434,452 B1 8/2002 Gray
6,459,965 B1 10/2002 Polivka et al.

(Continued)

*Primary Examiner*—Richard M. Camby
(74) *Attorney, Agent, or Firm*—Carlos Hanze; Enrique Mora

(57) ABSTRACT

A method and computer program product are provided for monitoring integrity of a railroad train and determining passage of the train relative to a plurality of virtual blocks defined by wireless transmissions along a section of track over which the train travels. The virtual blocks provide safeguards for the travel of the train relative to other trains on the section of the track when there is a shared use of the section of track. In aspects thereof, the method allows collecting data useful for evaluating conditions that may affect train integrity from at least one sensing device at a end of train location. The method further allows collecting data at a head-of-train location, with the data collected at the head-of-train corresponding to the type of data collected at the end-of-train location. The data collected at the end-of-train and at the head-of train location is processed to determine whether the entire train has cleared a respective one of the virtual blocks. In the event this determination is unable to reach a clearance for the respective block, a cautionary status is associated with the virtual block. The cautionary status for the virtual block is automatically communicated to an offboard system, which is responsible for managing shared use of the track by other trains.

15 Claims, 4 Drawing Sheets

U.S. PATENT DOCUMENTS 6,480,766 B2 11/2002 Hawthorne et al.
6,837,550 B2 1/2005 Dougherty et al.
6,845,953 B2 1/2005 Kane et al.
6,848,658 B2 2/2005 McAllister
6,853,888 B2 2/2005 Kane et al.
6,865,454 B2 3/2005 Kane et al.
7,092,801 B2 * 8/2006 Kane et al. ..... 701/19
2004/0205400 A1 10/2004 Vollmar et al.
2004/0236482 A1 11/2004 Kane et al.
2005/0085961 A1 4/2005 Kane et al.

* cited by examiner

| |
|---|
| FIG. 3A |
| FIG. 3B |

METHOD AND COMPUTER PROGRAM PRODUCT FOR MONITORING INTEGRITY OF RAILROAD TRAIN

FIELD OF THE INVENTION

The present invention is generally related to railroad trains, and more particularly, to techniques for monitoring integrity of a railroad train and determining passage of the train relative to a plurality of virtual blocks defined along a rail track over which the train travels.

BACKGROUND OF THE INVENTION

Traditional rail traffic signal systems have used an extensive array of wayside equipment to control railway traffic and maintain safe train separation distances. In these traditional systems railway control is achieved by detecting the presence of a train, determining a route availability for each train, conveying the route availability to a train's crew, and controlling the movement of the train in accordance with the route availability.

The presence of a train is typically detected directly through a sensor device, or track circuit, associated with a specific section of the rails, referred to as a block. The presence of a train causes an impedance change in a block's track circuit. In this manner, the occupancy of each block is determined. Vital decision logic is employed, utilizing the block occupancy information in conjunction with other information provided, such as track switch positions, to determine a clear route availability for trains. Traditional railway systems require the installation and maintenance of expensive apparatus on the wayside for communicating route availability to approaching trains. The wayside equipment physically displays signals, or aspects, that are interpreted by a crew on board a train approaching the signaling device. Thus, the interpretation of signal aspects can be subject to human error through confusion, inattention or inclement weather conditions.

An alternative to conventional track circuit-based signaling systems are communication-based train control (CBTC) systems. These train control systems generally include a computer at one or more fixed locations for determining the movement, authority and/or constraints applicable to each specific train. The computer then transmits this train-specific information in unique messages addressed or directed to each individual train.

BRIEF DESCRIPTION OF THE DRAWINGS

Advantages of the present invention will be more apparent from the following description in view of the accompanying drawings where.

DETAILED DESCRIPTION OF THE INVENTION

Figure 1:
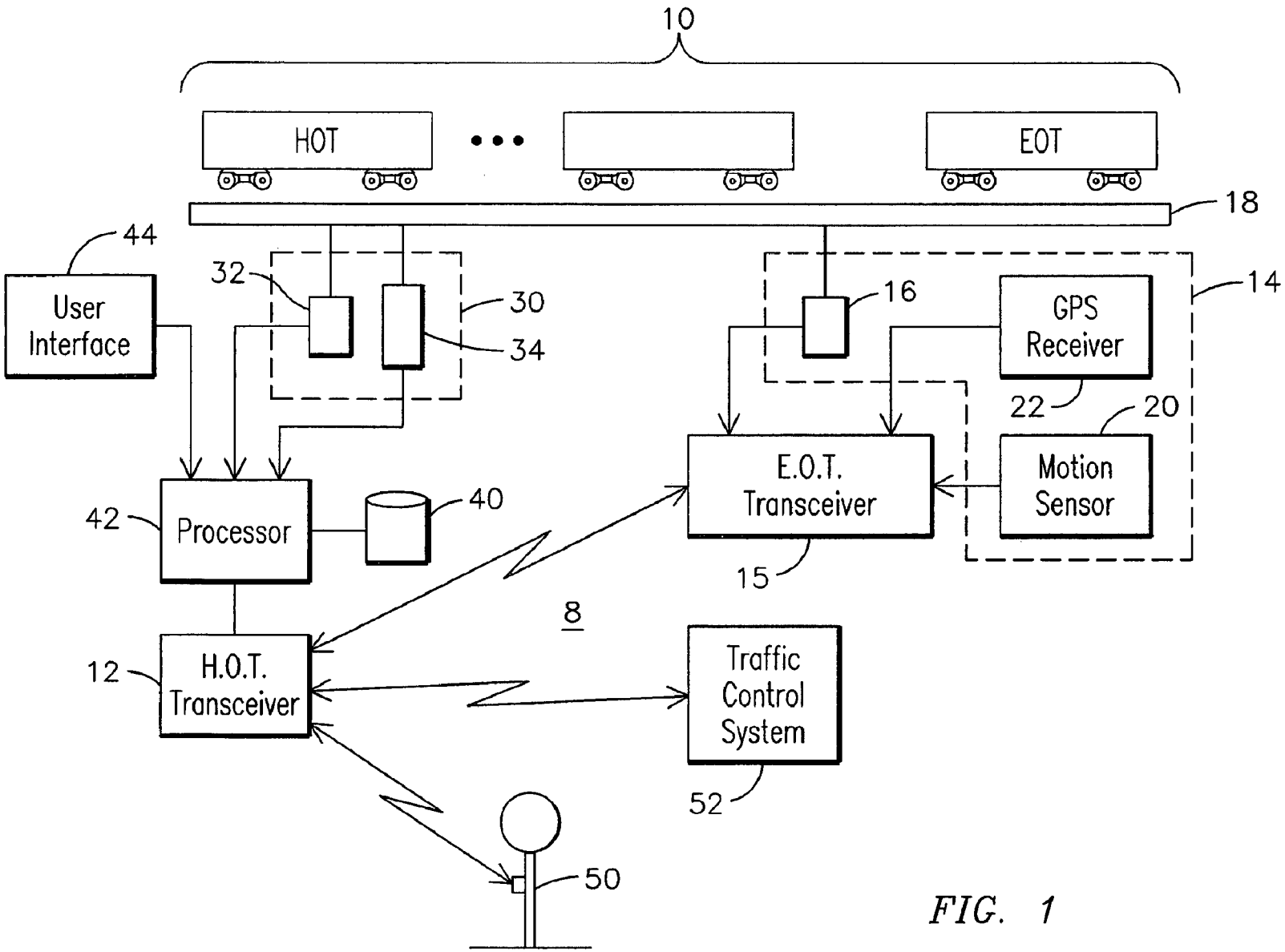
FIG. 1 is a block diagram of an exemplary system for monitoring integrity of a railroad train and determining passage of the train relative to a plurality of virtual blocks.

Before describing in detail an exemplary system in accordance with aspects of the present invention, it should be observed that such aspects reside primarily in a novel structural combination of standard sensing devices and computational modules configured to process data from such sensing devices and not necessarily in the particular specific configurations of such devices. Accordingly, the structure, control and arrangement of these standard devices have been illustrated in the drawings by readily understandable block diagrams which show just those specific details that are considered pertinent to the present invention, so as not to burden the disclosure with superfluous details that will be readily apparent to those skilled in the art having the benefit of the description herein. Thus, the block diagram illustrations of the figures may not necessarily represent the physical structural arrangement of the exemplary system, but are primarily intended to illustrate the major components of the system in a convenient functional grouping, whereby the present invention may be more readily understood.

FIG. 1 is a block diagram of an exemplary onboard system 8 for monitoring integrity of railroad train 10 and determining passage of the train relative to a plurality of virtual blocks, such as may be defined by wireless transmissions along a section of track over which the train travels. Train 10 is generally made up of a plurality of railcars and one or more locomotives that when interconnected to one another constitute a single train. The train generally includes a pneumatic line 18 interconnected among railcars and locomotives therein, as may be used for driving pneumatically driven equipment, such as air brakes. The virtual blocks provide safeguards for the travel of the train relative to other trains on the section of the track when there is a shared use of the section of track. As used herein virtual blocks refer to blocks as may be derived by wireless transmissions without the utilization of track circuits.

Aspects of the present invention recognize that there may be a plurality of failure modes that can affect a determination of train integrity, such as whether sections of the train have become separated from one another (train separation), that could lead to an erroneous determination of a train having actually cleared a boundary of a respective one of the virtual blocks. For example, if a blockage in a pneumatic line (e.g., an airline) that extends along the entire length of the train were to occur, just monitoring a front airline pressure at a head-of train (H.O.T.) location may not be able to detect a train separation condition since a blockage upstream of the separation point would prevent quick detection of pressure loss in the airline.

Similarly, just monitoring motion of an end-of-train (E.O.T.) location may not be able to detect a train separation condition. For example, the E.O.T. may continue to move with forward motion even though a train separation has occurred. Thus, aspects of the present invention identify such failure modes and build up multiple detection layers through the use of multiple sensing devices configured to monitor a different parameter and generate data useful for evaluating whether at least one of the failure modes has occurred. The foregoing combination of data results in a highly reliable system for monitoring and determining passage of a train relative to the plurality of virtual blocks.

In one exemplary embodiment, system 8 may include a H.O.T. transceiver 12 in communication (e.g., wireless communication) with a suite of E.O.T. sensing devices 14 by way of an E.O.T. transceiver 15. For example, the suite of sensing devices 14 may include an E.O.T. pressure-sensing device 16 pneumatically coupled to the pneumatic line 18. The suite of sensing devices 14 may further include a motion sensor 20, such as an accelerometer, and a global positioning system receiver 22.

In one exemplary embodiment, system 8 may include a suite of H.O.T. sensing devices 30, such as one or more pressure sensing devices 32 and 34 as may be pneumatically coupled to pneumatic line 18. It will be appreciated that H.O.T. sensing devices that may already be part of a lead locomotive, such as speed and position sensing devices, or calculations performed by an onboard controller, may be used for evaluating E.O.T. data in combination with H.O.T. data.

A database 40 (or any suitable digital data storage device) may be used for storing a plurality of rules for relating the data collected at the head-of-train location to the data collected at the end-of-train location. These rules may be configured to reduce a probability of making an erroneous determination as to whether the entire train has cleared a boundary for a respective one of the virtual blocks. An example of a straightforward rule may be as follows: If H.O.T. pressure is maintained and a loss of E.O.T. pressure is sensed, then this combination of information may indicate lack of train integrity, even though a blocked airline condition may be present. Another exemplary rule may be as follows: If the magnitude of E.O.T. GPS-based speed is consistent with the magnitude of H.O.T. speed and accelerometer based motion indicates E.O.T. travel motion opposite to H.O.T. travel direction, then this combination of information may indicate lack of train integrity. For example, one separated section of the train could be moving opposite to another separated section of the train within a same range of speed.

A processor 42 is configured to process the data collected at the end-of-train and at the head-of train locations using the rules in database 40 to determine whether the entire train has actually cleared a respective one of the virtual blocks. In the event such a determination indicates clearance of the respective block, processor 42 may declare that virtual block as being unoccupied and thus available for another train to enter the block. Conversely, in the event such determination indicates a lack of clearance of the respective block, processor 42 may declare the virtual block as being occupied and thus unavailable for another train to enter the block. The foregoing block status information may be communicated to a train operator by way of a user interface 44.

In accordance with other aspects of the present invention, based on the results of the determination performed by processor 42, transceiver 12 (or any suitable onboard communication device) may be automatically commanded (without requiring any action by onboard personnel) by processor 42 to communicate to an offboard location, such as wayside equipment 50, and/or a centralized traffic control system 52, a present status of the virtual block as to whether or not such block is available for another train, or whether the system is unable to make a determination within an acceptable range of confidence and therefore communicate a cautionary status regarding one or more virtual blocks. This ability for automatically communicating virtual block status and/or to communicate a cautionary status in connection with any such blocks is particularly advantageous since it avoids the possibility of errors due to human intervention, such as may occur if an onboard operator has to interpret and report situational occurrences. Moreover, this conveniently reduces tasks for onboard personnel whom otherwise would have to perform actions for communicating block status to the offboard location.

Figure 2:
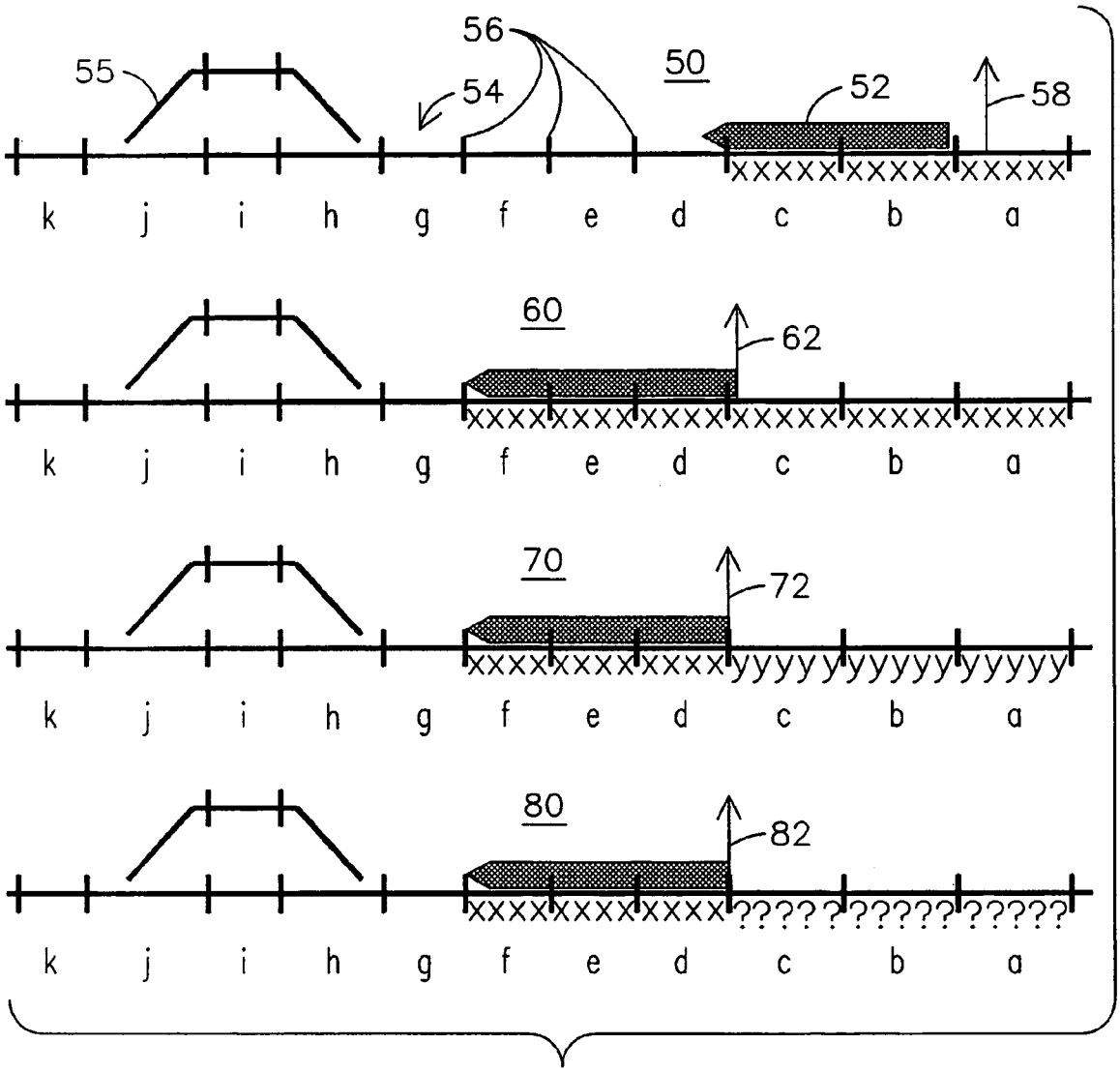
FIG. 2 show a temporal sequence of diagrams representing exemplary operational situations in connection with a train equipped with a system embodying aspects of the present invention

FIG. 2 represents a temporal sequence of diagrams representing exemplary operational situations in connection with a train equipped with a system embodying aspects of the present invention. Diagram 50 shows a train 52 on a track 54, where lines 56 represent boundaries for a plurality of virtual blocks derived using communication based-techniques. Track Section 55 represents a side section adjacent to track 54 that may also benefit from the innovations provided by the present invention. For an example of such communication-based techniques, reference is made to U.S. Pat. No. 6,459,965, titled "Method For Advanced Communication-Based Vehicle Control", which is herein incorporated by reference. A line 58 represents a last known rear location of train 52, as verified by processor 42 in combination with a last E.O.T. data update. In diagram 50, virtual blocks a, b and c (as represented with the underlying "xxxxx" letter pattern) may be designated as occupied and thus unavailable for other trains.

In diagram 60, a line 62 represents a request (e.g., polling) of new E.O.T. data. Note that blocks a, b and c continue to be designated as occupied as well as blocks d, e and f, since the requested E.O.T. data has not been received and processed by processor 42.

In diagram 70, a line 72 represents a new known rear location of train 52, as verified with the new E.O.T. data update. Note that in this case, virtual blocks a, b and c are now designated as clear (as represented by the "yyyyy" letter pattern). In the event the system is unable to satisfactorily verify train integrity, then blocks a, b and c would be designated as unverified (as represented by the question mark pattern) in diagram 80 and this loss of integrity information would be automatically communicated in the form of a cautionary message to the off-board location, such as traffic control system 52 (FIG. 1), where an appropriate action would be taken to communicate that caution information to other trains and/or independently determine the status of such blocks. It is contemplated that in one exemplary embodiment a next approaching train (upon receipt of a cautionary message from the traffic control system and having slowed down to a sufficiently safe train speed) may proceed to make a determination as to the status of the virtual blocks in question. For example, an operator in the next approaching train may visually verify as to the status of such virtual blocks. This information in turn would be communicated back to the traffic control system and/or would be used for setting any applicable wayside equipment to display an appropriate condition, such as whether or not the blocks are clear for safe train passage.

Figures 3, 3A:
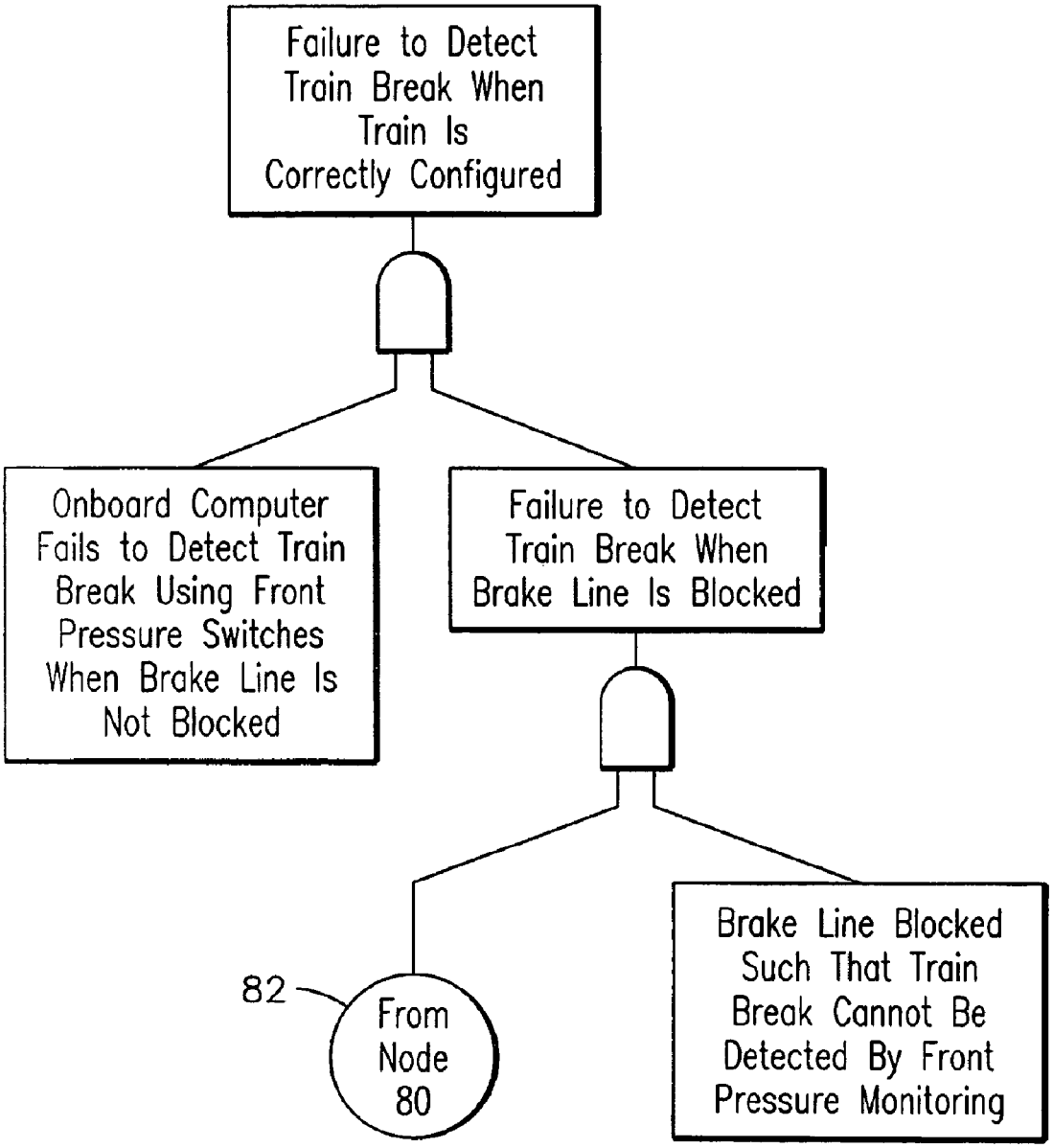
FIG. 3 is collectively made up of FIGS. 3A and 3B and illustrates a fault tree of exemplary failure modes that could lead to an erroneous determination as to whether an entire train has cleared a boundary for a respective one of the virtual blocks.
Figure 3B:
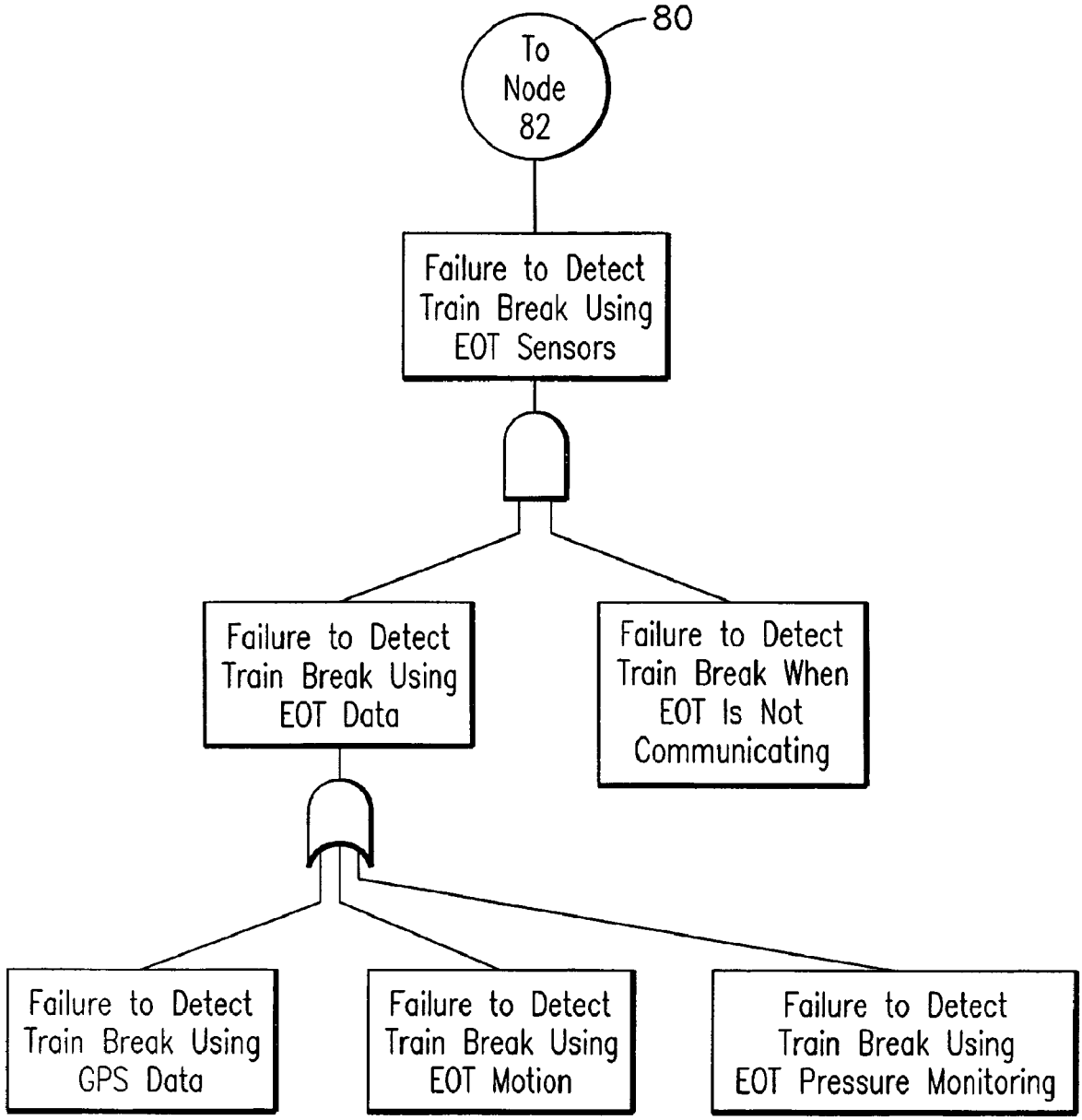

FIG. 3, collectively made up of FIGS. 3A and 3B, is a fault tree illustrating exemplary failure modes that could lead to an erroneous determination as to whether an entire train has cleared a boundary for a respective one of the virtual blocks. The fault tree may be a multi-layered tree and configured to evaluate aspects of the present invention regarding combined utilization of E.O.T. data together with H.O.T. data to meet a required safety level. The fault tree comprises elements that represent potential faults, such as enclosed by blocks interconnected by suitable logical connectors, e.g., OR and AND logical operators. Circles 80 and 82 represent interconnecting nodes for FIGS. 3A and 3B.

One exemplary manner of clearing block occupancy may be as follows:

When processor 42 has estimated (for example, within a predefined range) the E.O.T. train location relative to a virtual block boundary, processor 42 through H.O.T. transceiver 12 will poll the E.O.T. transceiver 15 for an information update. The information update may include the following data:

end-of-train air pressure from pressure sensing device 16,

GPS derived end-of-train speed from GPS receiver 22,

Accelerometer derived train motion status (e.g., stopped, forward motion, or reverse motion) from accelerometer 20.

Processor 42 may clear the block occupancy provided the following conditions are satisfied:

the predefined range for E.O.T. location is determined to be past the block boundary, the reported end-of-train air pressure is greater than a predefined minimum value for a given train type, the reported end-of-train GPS-based speed is consistent with a processor calculated H.O.T. speed, and the reported end-of train motion status is consistent with a processor calculated H.O.T. motion status.

It is contemplated that one may provide a suitable margin that accounts for train position measurement uncertainty (e.g., worst case H.O.T. location) plus the total time delay associated with the polling of the E.O.T. and the receipt of a response.

If processor 42 does not receive the requested information update from the E.O.T., then the block will remain occupied until the successful receipt of a subsequent requested information update.

An exemplary manner of supervising train integrity may be as follows:

Assuming one has initially established appropriate train length and train integrity, processor 42 monitors the H.O.T. pressure sensing devices 32 and 34. Processor 42 may determine that there has been a loss of train integrity when either of the two pressure measurements indicates a loss of air pressure below a specified threshold value.

If the processor 42 does not receive the requested E.O.T. data for a specified number of consecutive block clearing attempts, then processor 42 will declare a loss of train integrity. It is contemplated that one could reduce the operational impact of poor E.O.T. communication at specific track locations (e.g., tunnel, bridges) by not placing virtual block boundaries at those locations.

In addition to polling the E.O.T. for information as part of each block boundary clearing process, processor 42 is configured to ensure that the E.O.T. transceiver is periodically polled at some specified frequency.

Processor 42 will also monitor the end-of-train air pressure as part of the train integrity supervision function. Processor 42 may determine that there has been a loss of train integrity when a value of greater than a predefined threshold value (as defined for a given train type) is not received from the E.O.T. for longer than a specified period of time.

Processor 42 will monitor the end-of-train accelerometer-based motion status. Processor 42 may determine that there has been a loss of train integrity when a reported status that is consistent with a processor 12 calculated status is not received from the E.O.T. for longer than a specified period of time.

Processor 42 will monitor end-of-train GPS-based speed. Processor 42 will conclude that there has been a loss of train integrity when a reported speed that is consistent with a processor 12 calculated speed is not received from the E.O.T. for longer than a specified period of time.

Analytically-derived Exemplary Probabilities Regarding An Undetected Train Break Condition.

| | |
|---|---|
| H.O.T. Data Monitoring Only | = 5.7 × 10 − 6 |
| E.O.T. Data Monitoring Only | = 2.1 × 10 − 8 |
| Combined H.O.T. and E.O.T. Data | = 1.2 × 10 − 13 |

Accordingly, it is expected that the combined probability calculation will conservatively meet typical requirements, such as required by Safety Integrity Level (SIL) 4 train safety standards=1×10−10

Aspects of the invention can also be embodied as computer readable code on a computer readable medium. The computer readable medium is any data storage device that can store data, which thereafter can be read by a computer system. Examples of computer readable medium include read-only memory, random-access memory, CD-ROMS, DVDs, magnetic tape, optical data storage devices. The computer readable medium can also be distributed over network coupled computer systems so that the computer readable code is stored and executed in a distributed fashion.

Based on the foregoing specification, the invention may be implemented using computer programming or engineering techniques including computer software, firmware, hardware or any combination or subset thereof. Any such resulting program, having computer-readable code means, may be embodied or provided within one or more computer-readable media, thereby making a computer program product, i.e., an article of manufacture, according to the invention. The computer readable media may be, for example, a fixed (hard) drive, diskette, optical disk, magnetic tape, semiconductor memory such as read-only memory (ROM), etc., or any transmitting/receiving medium such as the Internet or other communication network or link. The article of manufacture containing the computer code may be made and/or used by executing the code directly from one medium, by copying the code from one medium to another medium, or by transmitting the code over a network.

An apparatus for making, using or selling the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody the invention as set forth in the claims.

User input may be received from the keyboard, mouse, pen, voice, touch screen, or any other means by which a human can input data to a computer, including through other programs such as application programs.

One skilled in the art of computer science will easily be able to combine the software created as described with appropriate general purpose or special purpose computer hardware to create a computer system or computer subsystem embodying the method of the invention.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim:

1. A method for monitoring integrity of a railroad train and determining passage of the train relative to a plurality of virtual blocks defined by wireless transmissions along a section of track over which the train travels, with said virtual blocks providing safeguards for the travel of the train relative to other trains on the section of the track when there is a shared use of the section of track, said method comprising:

identifying a plurality of failure modes that may lead to an erroneous determination that the entire train has cleared a boundary for a respective one of said virtual blocks;

collecting data at an end-of-train location, said data being collected from multiple sensing devices, wherein each of said sensing devices monitors a different parameter and generates data useful for evaluating whether at least one of said failure modes has occurred;

collecting data at a head-of-train location, with the data collected at the head-of-train corresponding to the type of data collected at the end-of-train location;

storing a plurality of rules for relating the data collected at the head-of-train location to the data collected at the end-of-train location for reducing a probability of making an erroneous determination as to whether the entire train has cleared a boundary for a respective one of said virtual blocks;

processing the data collected at said end-of-train and at said head-of train location using the stored rules to determine whether the entire train has cleared a respective one of said virtual blocks;

in the event said determination indicates clearance of said respective block, declaring said virtual block as being unoccupied and thus available for another train to enter the block; and in the event said determination indicates a lack of clearance of said respective block, declaring said virtual block as being occupied and thus unavailable for another train to enter the block.

2. The method of claim 1 wherein in the event a result of said determination is unable to determine a clearance for said respective block, associating with said virtual block a cautionary status; and automatically communicating to an offboard system the cautionary status associated with said virtual block, wherein said offboard system is responsible for managing a shared use of the track by other trains.

3. The method of claim 1 wherein the collecting of data at an end-of-train location comprises collecting data from a pressure sensing device pneumatically coupled to a pneumatic line that extends along the entire train.

4. The method of claim 1 wherein the collecting of data at an end-of-train location comprises collecting motion data from an inertial-based motion sensor.

5. The method of claim 1 wherein the collecting of data at an end-of-train location comprises collecting data from a global positioning system receiver.

6. The method of claim 1 wherein the processing of data collected at said end-of-train and at said head-of train location comprises acquiring new end-of-train data, relating said new end-of-train data to a corresponding new head-of train-data to ensure train integrity; and determining a new update for a last end-of-train position relative to the boundary for the respective one of said virtual blocks.

7. A method for monitoring integrity of a railroad train and determining passage of the train relative to a plurality of virtual blocks defined by wireless transmissions along a section of track over which the train travels, with said virtual blocks providing safeguards for the travel of the train relative to other trains on the section of the track when there is a shared use of the section of track, said method comprising:

collecting data useful for evaluating conditions that may affect train integrity from at least one sensing device at a end of train location;

collecting data at a head-of-train location, with the data collected at the head-of-train corresponding to the type of data collected at the end-of-train location;

processing the data collected at said end-of-train and at said head-of train location to determine whether the entire train has cleared a respective one of said virtual blocks;

in the event said determination is unable to reach a clearance for said respective block, associating with said virtual block a cautionary status; and automatically communicating to an offboard system the cautionary status of said virtual block, wherein said offboard system is responsible for managing shared use of the track by other trains.

8. The method of claim 7 wherein the processing of data collected at said end-of-train and at said head-of train location comprises acquiring new end-of-train data, relating said new end-of-train data to a corresponding new head-of train-data to ensure train integrity, and determining a new update for a present end-of-train position relative to a boundary for the respective one of said virtual blocks.

9. The method of claim 7 further comprising resetting the caution status associated with the virtual block to an occupied status or to an unoccupied status based on observations of a track section corresponding the virtual block.

10. The method of claim 9 wherein said observation are gathered from another train approaching said virtual block, and communicated to the offboard system.

11. A computer program product comprising a computer-usable medium having computer-readable code therein for monitoring integrity of a railroad train and determining passage of the train relative to a plurality of virtual blocks defined by wireless transmissions along a section of track over which the train travels, with said virtual blocks providing safeguards for the travel of the train relative to other trains on the section of the track when there is a shared use of the section of track, the computer-readable code comprising:

a software code module for collecting data at an end-of-train location, said data being collected from multiple sensing devices, wherein each of said sensing devices monitors a different parameter and generates data useful for evaluating conditions that may affect train integrity;

a software code module for collecting data at a head-of-train location, with the data collected at the head-of-train corresponding to the type of data collected at the end-of-train location;

a software code module for accessing a plurality of rules for relating the data collected at the head-of-train location to the data collected at the end-of-train location for reducing a probability of making an erroneous determination as to whether the entire train has cleared a boundary for a respective one of said virtual blocks;

a software code module for processing the data collected at said end-of-train and at said head-of train location using the accessed rules to determine whether the entire train has cleared a respective one of said virtual blocks;

in the event said determination indicates clearance of said respective block, a software code module for declaring said virtual block as being unoccupied and thus available for another train to enter the block; and in the event said determination indicates a lack of clearance of said respective block, said last-recited software code module declaring said virtual block as being occupied and thus unavailable for another train to enter the block.

12. The computer program product of claim 11 wherein the software code module for processing the data collected at said end-of-train and at said head-of train location comprises a software code module for acquiring new end-of-train data, a software code module for relating said new end-of-train data to a corresponding new head-of train-data to ensure train integrity; and a software code module for determining a new update for a last end-of-train position relative to the boundary for the respective one of said virtual blocks.

13. A computer program product comprising a computer-usable medium having computer-readable code therein for monitoring integrity of a railroad train and determining passage of the train relative to a plurality of virtual blocks defined by wireless transmissions along a section of track over which the train travels, with said virtual blocks providing safeguards for the travel of the train relative to other trains on the section of the track when there is a shared use of the section of track, said method comprising:

a software code module for collecting data useful for evaluating conditions that may affect train integrity from at least one sensing device at a end of train location;

a software code module for collecting data at a head-of-train location, with the data collected at the head-of-train corresponding to the type of data collected at the end-of-train location;

a software code module for processing the data collected at said end-of-train and at said head-of train location to determine whether the entire train has cleared a respective one of said virtual blocks;

in the event said determination is unable to reach a clearance for said respective block, a software code module for associating with said virtual block a cautionary status; and a software code module for automatically communicating to an offboard system the cautionary status of said virtual block, wherein said offboard system is responsible for managing shared use of the track by other trains.

14. The computer program product of claim 13 wherein the software code module for processing data collected at the end-of-train and at said head-of train location comprises a software code module for acquiring new end-of-train data, a software code module for relating said new end-of-train data to a corresponding new head-of train-data to ensure train integrity, and a software code module for determining a new update for a present end-of-train position relative to a boundary for the respective one of said virtual blocks.

15. The computer program product of claim 13 further comprising a software code module for resetting the caution status associated with the virtual block to an occupied status or to an unoccupied status based on observations of a track section corresponding to the virtual block.

* * * * *